US008061629B2

(12) United States Patent
Tranchant et al.

(10) Patent No.: US 8,061,629 B2
(45) Date of Patent: Nov. 22, 2011

(54) SPRAY DEVICE HAVING A PIEZOELECTRIC ELEMENT, AND USE THEREOF IN COSMETOLOGY AND PERFUMERY

(75) Inventors: Jean-François Tranchant, Marigny-les-Usages (FR); Sylvie Richer, Boigny-sur-Bionne (FR); Jean-Denis Sauzade, Grasse (FR)

(73) Assignee: LVMH Recherche, Saint Jean de Braye (FR)

( * ) Notice: Subject to any disclaimer, the term of this patent is extended or adjusted under 35 U.S.C. 154(b) by 260 days.

(21) Appl. No.: 12/293,053

(22) PCT Filed: Mar. 13, 2007

(86) PCT No.: PCT/FR2007/000433
§ 371 (c)(1),
(2), (4) Date: Sep. 15, 2008

(87) PCT Pub. No.: WO2007/104859
PCT Pub. Date: Sep. 20, 2007

(65) Prior Publication Data

US 2009/0065600 A1 Mar. 12, 2009

(30) Foreign Application Priority Data

Mar. 15, 2006 (FR) ..... 06 02281

(51) Int. Cl.
*B05B 1/08* (2006.01)

(52) U.S. Cl. ..... 239/102.2; 239/69; 239/326

(58) Field of Classification Search ..... 239/69, 239/86, 102.1, 102.2, 325, 326, 4
See application file for complete search history.

(56) References Cited

U.S. PATENT DOCUMENTS

| | | | | |
|---|---|---|---|---|
| 3,904,896 | A * | 9/1975 | Guntersdorfer | 310/318 |
| 4,301,093 | A | 11/1981 | Eck | |
| 4,337,896 | A | 7/1982 | Berger et al. | |
| 4,877,989 | A * | 10/1989 | Drews et al. | 310/323.01 |
| 4,912,357 | A * | 3/1990 | Drews et al. | 310/323.01 |

FOREIGN PATENT DOCUMENTS

| | | |
|---|---|---|
| DE | 26 56 370 | 6/1978 |
| EP | 0 004 039 | 9/1979 |
| EP | 0 300 319 | 1/1989 |
| EP | 0 389 665 | 10/1990 |

OTHER PUBLICATIONS

International Search Report; European Patent Office; Aug. 1, 2007; Form PCT/ISA/210.
French Search Report; European Patent Office; Nov. 22, 2006; Epo Form 1503.

* cited by examiner

*Primary Examiner* — Christopher Kim
(74) *Attorney, Agent, or Firm* — Miller, Matthias & Hull, LLP

(57) ABSTRACT

Spray device comprising a piezoelectric element, a sonotrode having a base coupled to the piezoelectric element, and a tube extending as far as a horn, a drive circuit for vibrating the piezoelectric element, and a feed device for bringing the product to be sprayed up to the front face of the horn. The sonotrode mainly vibrates in a mode parallel to the tube, the horn being dimensioned so as not to flex along the longitudinal axis, without flexing when the drive circuit vibrates the piezoelectric element. This spray device is applicable in cosmetology and in perfumery.

13 Claims, 1 Drawing Sheet

FIG.1.
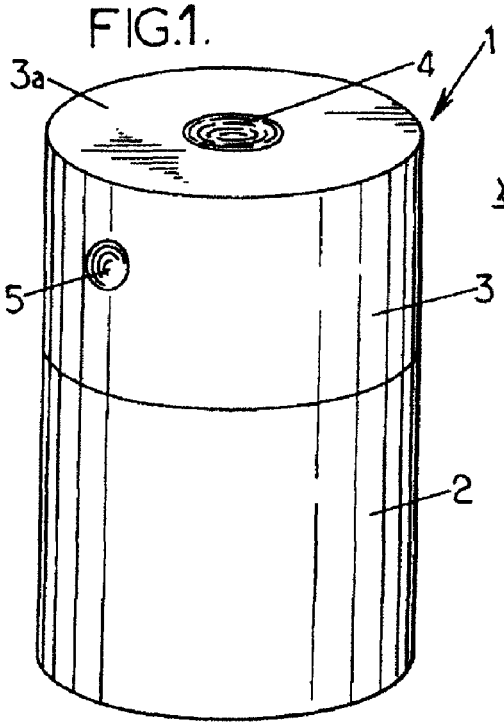
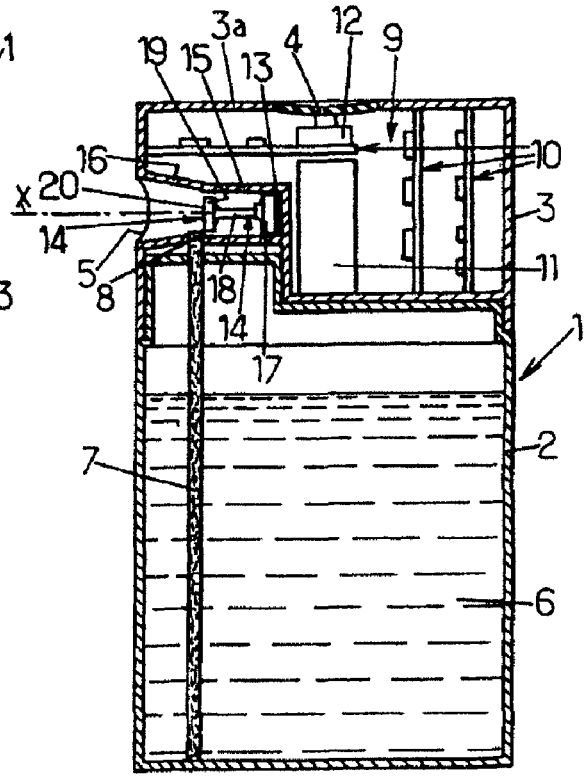
FIG.2.
FIG.3.
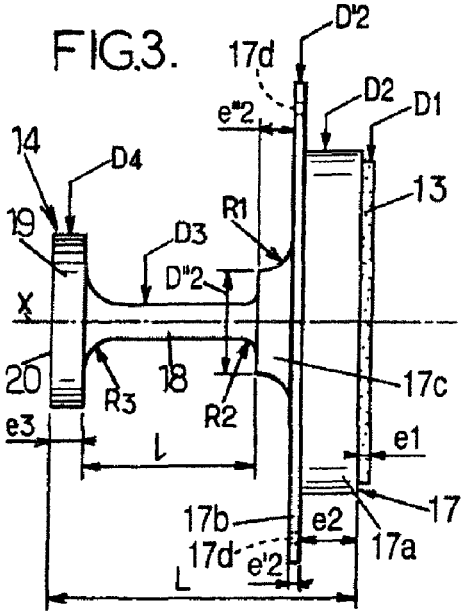
FIG.4.
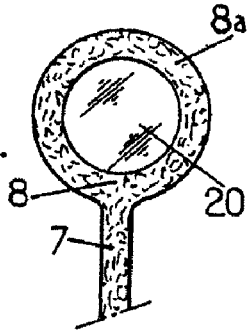
FIG.5.
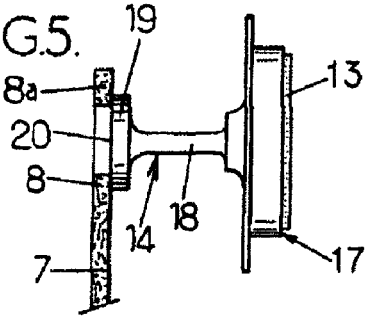

SPRAY DEVICE HAVING A PIEZOELECTRIC ELEMENT, AND USE THEREOF IN COSMETOLOGY AND PERFUMERY

CROSS-REFERENCE TO RELATED APPLICATIONS

This application is a U.S. national stage filing of International Patent Application No. PCT/FR2007/000433 filed on Mar. 13, 2007, which claims priority under the Paris Convention to French Patent Application No. 06 02281, filed on Mar. 15, 2006.

FIELD OF THE DISCLOSURE

The present invention relates to spray devices that have a piezoelectric element, and to the use of such devices in cosmetology and perfumery.

BACKGROUND OF THE DISCLOSURE

More specifically, the invention relates to a spray device comprising:

a piezoelectric element, a sonotrode comprising a base coupled to the piezoelectric element and a horn tube narrower than the base extending along a longitudinal axis from the base to a horn mouth that is wider than the horn tube, said horn mouth having a front face directed away from the horn tube, a control circuit designed to cause the piezoelectric element to vibrate, and a feed device for feeding product that is to be sprayed, this feed device being designed to carry the product that is to be sprayed as far as the front face of the horn mouth, the sonotrode vibrating in a mode parallel to the longitudinal axis, the horn mouth being sized to move essentially along said longitudinal axis without flexing when the control circuit causes the piezoelectric element to vibrate.

Document EP-A-0 389 665 describes an example of a spray device such as this.

SUMMARY OF THE DISCLOSURE

It is a particular object of the present invention to improve known spray devices of this type in order to improve their effectiveness and, in particular, reduce their electrical power consumption.

To this end, according to the invention, a spray device of the kind in question is characterized in that the piezoelectric element and the horn tube have diameters that are such that the ratio of the diameter of the piezoelectric element to the diameter of the horn tube lies between 5 and 10.

By virtue of these measures, the effectiveness of the sonotrode is optimized by optimizing the coupling between the piezoelectric element and the horn mouth, and by putting the entire surface area of the horn mouth to use, this horn mouth then acting like a piston. In the same stroke, the electrical power consumed by the spray device for a given flow rate of sprayed product can thus be reduced.

In various embodiments of the method according to the invention, recourse may possibly also be had to one and/or more of the following measures:

the control circuit is designed to cause the piezoelectric element to vibrate at an operating frequency of between 20 and 200 kHz, preferably between 40 and 100 kHz, and more preferably still between 50 and 80 kHz;

the sonotrode is sized such that the horn mouth moves at an amplitude in excess of 0.01 mm when the control circuit causes the piezoelectric element to vibrate;

the sonotrode can be inscribed inside a cylindrical volume of less than 1.5 $cm^3$;

the control circuit powers the piezoelectric element at an electrical power of less than 1 W;

the feed device supplying product that is to be sprayed is connected to a reservoir containing the product that is to be sprayed, which product has, at 20° C., a dynamic viscosity of between 1 and 200 mPa·s, preferably between 3 and 50 mPa·s;

the piezoelectric element is in the form of a disk with a diameter of less than 15 mm and a thickness of less than 2 mm;

the sonotrode exhibits symmetry of revolution about the longitudinal axis, with an outside diameter and an overall length that are such that the ratio of said overall length to said outside diameter is less than 2;

the piezoelectric element and the horn mouth have diameters that are such that the ratio of the diameter of the piezoelectric element to the diameter of the horn mouth is between 1 and 2;

the horn mouth has a diameter and a thickness that are such that the ratio of the diameter of the horn mouth to the thickness of the horn mouth is less than 5;

the sonotrode is made of at least one material chosen from aluminum, steel, titanium, and alloys of such materials;

the feed device comprises a wick with one end in contact with the horn mouth of the sonotrode;

the end of the wick has an annular part in contact with a front face of said sonotrode horn mouth and surrounding a central part of said front face.

Furthermore, another subject of the invention is a use of a device as defined hereinabove for spraying a liquid which has a dynamic viscosity of between 1 and 200 mPa·s, preferably between 3 and 50 mPa·s.

The liquid thus sprayed forms a kind of mist made up of droplets of a very small size, of the order of a few tens of microns, particularly ranging between 30 μm and 50 μm.

According to one particular embodiment of the invention, said liquid is a cosmetic composition.

Use of the device according to the invention is particularly advantageous in the case of cosmetic products, especially cosmetic care products. These products, thus sprayed toward the skin in the form of a mist that hangs in the air, afford a profound feeling of freshness and well-being.

According to another embodiment of the invention, said liquid is a perfume composition, such as an eau de toilette, a perfume or an eau de cologne. The use according to the invention for this type of composition is also particularly well appreciated by users, because it plays a part in developing the fragrances.

Further features and advantages of the invention will become apparent in the course of the following description of one of the embodiments and one of the alternative forms of embodiment thereof, which are given by way of nonlimiting examples, with reference to the attached drawings.

BRIEF DESCRIPTION OF THE DRAWINGS

In the drawings:

FIG. 1 is an overall view of a spray device according to one embodiment of the invention, FIG. 2 is a view in vertical section of the device of FIG. 1, FIG. 3 is a detail view showing the piezoelectric element and the sonotrode of the device of FIGS. 1 and 2, and FIGS. 4 and 5 respectively are front and side views of the sonotrode equipped with a wick according to an alternative form of embodiment of the invention.

In the various figures, the same references denote elements that are identical or similar.

DETAILED DESCRIPTION OF THE DISCLOSURE

FIG. 1 depicts a spray device 1 which may, for example, have the overall shape of a cylinder of revolution centered on a vertical axis, comprising a reservoir 2 surmounted by a spray head 3, which may for example comprise an actuating button 4 on its top face 3*a* and an outlet opening 5 for the sprayed product on its cylindrical side face. The device 1 is portable and can be held in the hand.

As may be seen in FIG. 2, the spray head 3 may be fitted onto the upper part of the reservoir 2, which contains a reserve 6 of liquid product that is to be sprayed, for example an aqueous or non-aqueous cosmetic product, a skin-care product or some other product. The product that is to be sprayed may, for example, have, at 20° C., a dynamic viscosity of between 1 and 200, preferably 3 and 50 mPa·s.

Examples of compositions of products that can be sprayed by the spray device 1 are given hereinafter, together with their respective viscosities quoted in mPa·s at 20° C. The viscosity measurements were taken using a Brookfield LV (Low Viscosity) viscometer using spindle No. 1 (manufacturer reference):

a) Scented Body Lotion

| | |
|---|---|
| Dimethicone | 6% |
| Alcohol | 5% |
| Perfume | 3.5% |
| Diethylhexylcyclohexanoate | 5% |
| Glycerine | 2.5% |
| Stearyl dimethicone | 1.5% |
| Cetyl alcohol | 1.1% |
| Stearyl alcohol | 1.1% |
| Steareth-21 | 0.7% |
| Steareth-2 | 0.3% |
| Methyl paraben | 0.4% |
| Tocopheryl acetate | 0.1% |
| Carbomer | 0.1% |
| Sodium hydroxide | 0.05% |
| Water | Qsp 100% |

Viscosity: 150 mPa · s
Measurements taken at a speed of 30 revolutions/minute b) Eau de Toilette

| | |
|---|---|
| 96.2 alcohol | 78% |
| Perfume concentrate | 20% |
| Benzophenone-3 | 0.2% |
| Water | 1.8% |

Viscosity: 5 mPa · s
Measurements taken at a speed of 60 revolutions/minute c) Lotion

| | |
|---|---|
| Alcohol | 5% |
| Glycerine | 2% |
| Butylene glycol | 1% |
| Hydrogenated castor oil Peg-60 | 1% |
| PEG 32 | 0.5% |

-continued

| | |
|---|---|
| Phenoxyethanol | 0.5% |
| Parabens | 0.3% |
| Perfume | 0.05% |
| Water | QSP 100 |

Viscosity: 50 mPa · s
Measurements taken at a speed of 60 revolutions/minute d) Care Serum

| | |
|---|---|
| Cyclopentosiloxane | 24% |
| Butylene glycol | 4% |
| Poly (methyl methacrylate) | 3% |
| Glycerine | 3% |
| Alcohol | 2.5% |
| Polysorbate-20 | 1.5% |
| Hydrogenated castor oil Peg-60 | 1% |
| Polyacrylamide | 0.6% |
| Acrylate/C10-30 alkylacrylate crosslinked polymer | 0.2% |
| Perfume | 0.2% |
| Active ingredient | 0.2% |
| Xanthan | 0.05% |
| Carbomer | 0.05% |
| Cellulose | 0.05% |
| Sodium hyaluronate | 0.05% |
| Water | Qsp 100 |

Viscosity: 100 mPa · s
Measurements taken at a speed of 30 revolutions/minute

The reservoir 2 further comprises a feed device for supplying product that is to be sprayed and that is able to convey product that is to be sprayed to the spray head 3. In the example depicted here, this feed device comprises a wick 7 operating by capillary action and the upper end 8 of which projects out of the reservoir 2, entering the spray head 3, as will be explained hereinafter.

The spray head 3, for its part, comprises a control compartment 9 in which there is housed an electronic control circuit 10 powered by at least one electric cell or battery 11. The electronic control circuit 10 comprises a switch 12 that can be operated using an actuating button 4, which button may for example take the form of a flexible portion of the upper face 3*a* of the spray head. More specifically, the spray head 3 may have a substantially rigid plastic outer shell that has a recess in the region of the switch 12, which recess is blanked off by a flexible elastomer wall that forms the aforementioned button 4.

The electronic control circuit 10 is designed to cause the vibration of an ultrasound piezoelectric element 13, made of ceramic or the like, which is coupled to a sonotrode 14 made, for example, of aluminum, steel, titanium or an alloy of such materials (the sonotrode 14 may be made of one or more materials). The piezoelectric element 13 and the sonotrode 14 are fitted into a sonotrode housing 16 created in the spray head 3. This sonotrode housing is, for example, substantially in the shape of a cylinder of revolution and communicates with the outlet opening 5 via a divergent passage 16 in the example depicted here.

As may be seen in FIGS. 2 and 3, the sonotrode 14, like the piezoelectric element 13, may exhibit symmetry of revolution about a longitudinal axis X. Said sonotrode 14 has a base 17 coupled to the piezoelectric element 13 and a horn tube 18, narrower than the base, which extends along the longitudinal axis X from said base as far as a horn mouth 19 that is wider than the horn tube 18. The flat front face 21 of the horn mouth is in contact with the upper end 8 of the wick 7 so that the product that is to be sprayed is carried by capillary action as far as said front face (see FIG. 2).

Thus, when a user depresses the actuating button 4, the control circuit 10 causes the piezoelectric element 13 to vibrate, preferably at an ultrasound operating frequency. This operating frequency may range between 20 and 200 kHz, preferably between 40 and 100 kHz, and more preferably still between 50 and 80 kHz.

The vibrations of the piezoelectric element 13 are transmitted to the horn mouth 20 via the base 17 and the horn tube 18, so as to atomize the liquid product that has been carried as far as the front face 20 of the horn mouth by the wick 7.

Given the relatively low aforementioned operating frequency, particularly when this frequency is below 100 kHz, the energy losses in the sonotrode are limited, this playing a part in limiting the electrical power consumption of the spray device.

According to the invention, the sonotrode 14 is dimensioned to vibrate essentially in a longitudinal mode parallel to the axis X, the horn mouth 19 being dimensioned to move along the longitudinal axis X without flexing when the control circuit causes the piezoelectric element to vibrate at the aforementioned frequencies. This then optimizes the efficiency of the sonotrode, because it has been found that the vibration of said sonotrode in the longitudinal mode optimizes the coupling between the piezoelectric element 13 and the horn mouth 19. In the context of this text, the absence of flexing of the horn mouth means that there is no deformation of the horn mouth in the direction perpendicular to the plane of the horn mouth. Thus, the lack of flexing of the horn mouth allows it to operate like a rigid piston, so that the entire surface area of the horn mouth can be put to good use for spraying the liquid product.

The sonotrode 14 may, for example, be dimensioned such that it can be inscribed inside a cylindrical volume of less than 1.5 $cm^3$ and it is powered for example at an electrical power of less than 1 W while at the same time allowing an amplitude of vibration in excess of 0.01 mm at the horn mouth 19, thus allowing the product to be sprayed to a distance of between 100 and 300 mm from the head 3, depending on the product that is to be sprayed.

As depicted in FIG. 3, in the particular example considered here, the piezoelectric element 13 is, for example, a multilayer resonant ceramic, preferably made of lead zirconotitanates (PZT), for example a ceramic sold under the reference C 202 by Fuji Ceramics Co, which is in the shape of a disk with a diameter D1 of less than 15 mm (for example of the order of 8 to 10 mm) and with a thickness e1 of less than 1 mm (for example of the order of 0.3 mm).

Furthermore, in terms of the sonotrode 14, this may be made of aluminum or of an aluminum alloy in the example considered.

The base 17 of the sonotrode may comprise:

a disk-shaped first part 17*a* attached to the piezoelectric element 13 (the piezoelectric element 13 is, for example, bonded to said first part 17*a*), and which may have a diameter D2 of less than 15 mm (for example of the order of 10 mm) and a thickness e2 of less than 2 mm (for example of the order of 1.7 mm), a disk-shaped second part 17*b*, thinner and wider than the first part 17*a* and extending said first part 17*a* toward the horn tube 18; this disk-shaped second part may have a diameter D'2 of less than 15 mm (for example of the order of 14 mm) and a thickness e'2 of less than 1 mm (for example of the order of 0.3 mm); the periphery of the second part 17*b* may also comprise means 17*d* of attachment such as fixing holes that allow the sonotrode to be fixed into the spray head 3, a transition part 17*c* connected to the horn tube 18 and extending the disk-shaped second part 17*b*; the transition part 17*c* has an end diameter D"2 of less than 5 mm (for example of the order of 3 mm) toward the horn tube 18; this transition part 17*c* may connect to the disk-shaped second part 17*b* via a fillet radius R1 of less than 2 mm (for example of the order of 1 mm), and have a thickness e"2 substantially equal to said fillet radius.

The horn tube 18 has a substantially cylindrical shape with an outside diameter D3 of less than 2 mm (for example of the order of 1 mm) and a length 1 of between 4 and 6 mm (for example of the order of 5 mm). This horn tube 18 may connect to the transition part 17*b* and to the horn mouth 19 via fillet radii smaller than 1 mm (for example of the order of 0.5 mm).

The horn mouth 19 is in the form of a disk with an outside diameter D4 of less than 8 mm (for example of the order of 5 mm) and a thickness e3 of less than 2 mm (for example of less than 1 mm).

Advantageously, the maximum outside diameter of the sonotrode 14, in this instance the diameter D'2, and the overall length L of the sonotrode are such that the ratio L/D'2 of said overall length to said maximum outside diameter is smaller than 2.

Furthermore, the ratio D1/D3 of the diameter of the piezoelectric element 13 to the diameter of the horn tube is preferably between 5 and 10.

In addition, the ratio D4/e3 of the diameter of the horn mouth to the thickness of the horn mouth is preferably smaller than 5.

Finally, the ratio D1/D4 between the diameter of the piezoelectric element 13 and the diameter of the horn mouth 19 is preferably between 1 and 2.

In the alternative form of FIGS. 4 and 5, the upper end 8 of the wick has an annular part 8*a* in contact with a front face 20 of the horn mouth of the sonotrode and surrounding a central part of said front face 20, this proving to be particularly effective in conveying the product that is to be sprayed as far as the front face 20 of the horn mouth.

The invention claimed is:

1. A spray device comprising:

a piezoelectric element, a sonotrode comprising a base coupled to the piezoelectric element and a horn tube narrower than the base extending along a longitudinal axis from the base to a horn mouth that is wider than the horn tube, said horn mouth having a front face directed away from the horn tube, a control circuit designed to cause the piezoelectric element to vibrate, and a feed device for feeding product that is to be sprayed, this feed device being designed to carry the product that is to be sprayed as far as the front face of the horn mouth, the sonotrode vibrating in a mode parallel to the longitudinal axis, the horn mouth being sized to move essentially along said longitudinal axis without flexing when the control circuit causes the piezoelectric element to vibrate, wherein the piezoelectric element and the horn tube have diameters that are such that the ratio of the diameter of the piezoelectric element to the diameter of the horn tube lies between 5 and 10, and wherein the feed device comprises a wick with one end in contact with the horn mouth of the sonotrode.

2. The spray device as claimed in claim 1, in which the piezoelectric element is in the form of a disk with a diameter of less than 15 mm and a thickness of less than 2 mm.

3. The spray device as claimed in claim 1, in which the sonotrode exhibits symmetry of revolution about the longitudinal axis, with an outside diameter and an overall length that are such that the ratio of said overall length to said outside diameter is less than 2.

4. The spray device as claimed in claim 1, in which the piezoelectric element and the horn mouth have diameters that are such that the ratio of the diameter of the piezoelectric element to the diameter of the horn mouth is between 1 and 2.

5. The spray device as claimed in claim 1, in which the sonotrode is made of at least one material chosen from aluminum, steel, titanium, and alloys of such materials.

6. The spray device as claimed in claim 1, in which the end of the wick has an annular part in contact with a front face of said sonotrode horn mouth and surrounding a central part of said front face.

7. The spray device according to claim 1, wherein the control circuit is designed to cause the piezoelectric element to vibrate at an operating frequency of between about 40 and about 100 kHz.

8. The spray device according to claim 7, wherein the control circuit is designed to cause the piezoelectric element to vibrate at an operating frequency of between about 50 and about 80 kHz.

9. The spray device according to claim 1, wherein said product has, at 20° C., a dynamic viscosity of between about 3 and about 50 mPa·s.

10. A method of using a device as claimed in claim 1, for spraying a liquid which, at 20° C., has a dynamic viscosity of between 1 and 200 mPa·s, the method comprising:

providing the device of claim 1;

bringing said liquid to the front face of the horn mouth; and vibrating said front face by the piezoelectric element to spray said liquid.

11. The method as claimed in claim 10, wherein said liquid is a cosmetic composition.

12. The method as claimed in claim 10, wherein said liquid is a perfume composition.

13. The method as claimed in claim 10, wherein said liquid has, at 20° C., a dynamic viscosity of between about 3 and about 50 mPa·s.

* * * * *